US009777677B2

(12) United States Patent
Timmer et al.

(10) Patent No.: US 9,777,677 B2
(45) Date of Patent: Oct. 3, 2017

(54) VALVE FOR VENTILATION OF A TANK

(71) Applicant: Dr. Ing. h.c. F. Porsche Aktiengesellschaft, Stuttgart (DE)

(72) Inventors: Markus Timmer, Leonberg (DE); Stephan Becker, Sachsemheim (DE)

(73) Assignee: DR. ING. H.C.F. PORSCHE AKTIENGESELLSCHAFT, Stuttgart (DE)

( * ) Notice: Subject to any disclaimer, the term of this patent is extended or adjusted under 35 U.S.C. 154(b) by 189 days.

(21) Appl. No.: 14/540,526

(22) Filed: Nov. 13, 2014

(65) Prior Publication Data

US 2015/0136249 A1 May 21, 2015

(30) Foreign Application Priority Data

Nov. 15, 2013 (DE) ..... 10 2013 112 586

(51) Int. Cl.
*F02M 25/08* (2006.01)

(52) U.S. Cl.
CPC ..... *F02M 25/0836* (2013.01); *F02M 25/089* (2013.01); *F02M 25/0872* (2013.01); *Y10T 137/7758* (2015.04); *Y10T 137/7837* (2015.04)

(58) Field of Classification Search
CPC ..... F02M 25/0836; F02M 25/0872; F02M 25/089; F02D 41/003; F02D 41/0032;
(Continued)

(56) References Cited

U.S. PATENT DOCUMENTS 5,495,749 A * 3/1996 Dawson ..... F04B 9/1215 73/114.39
5,524,662 A * 6/1996 Benjey ..... B60K 15/03519 137/43

(Continued)

FOREIGN PATENT DOCUMENTS

FR 2827635 1/2003
JP H04105995 2/1992

(Continued)

OTHER PUBLICATIONS

Office Action Dated Oct. 28, 2015.
Korean Office Action.
Korean Patent Appl. No. H07-180624—Korean Office Action.

*Primary Examiner* — Carlos A Rivera
*Assistant Examiner* — Carl Staubach
(74) *Attorney, Agent, or Firm* — Gerald E. Hespos; Michael J. Porco; Matthew T. Hespos

(57) ABSTRACT

A tank ventilation valve has a housing (21), a closing member (4), a sealing seat (5) and a first space (17). A second space (18) is connected to the first space (17) via a control opening (19) that surrounds the sealing seat (5). A spring (6) pretensions the closing member (4) against the sealing seat (5) and closes the control opening (19). The closing member (4) opens as a function of a pressure difference between the first and second spaces (17, 18). The opened closing member (4) opens the control opening (19) so that the first space (17) is connected to a first line (2) connects to fresh air. The second space (18) is connected to a second line (3) that is attachable to a filter. Structure is provided to exert a further negative pressure on the closing member (4) to move the closing member (4) into the open position.

7 Claims, 6 Drawing Sheets

(58) Field of Classification Search
CPC ..... B60K 15/035; B60K 15/03504; B60K 15/03514; B60K 15/03519
USPC ..... 123/516, 518–521; 73/114.38–114.45; 137/485, 493, 511
See application file for complete search history.

(56) References Cited

U.S. PATENT DOCUMENTS

| | | | | |
|---|---|---|---|---|
| 5,584,278 | A * | 12/1996 | Satoh | B60K 15/03519 123/516 |
| 6,283,097 | B1 * | 9/2001 | Cook | F02M 25/0818 123/198 D |
| 6,623,012 | B1 | 9/2003 | Perry | |
| 6,966,347 | B2 | 11/2005 | Teutsch et al. | |
| 7,216,635 | B1 * | 5/2007 | Roche | F02M 37/20 123/198 D |
| 2005/0034711 | A1 * | 2/2005 | Yamada | F02M 17/04 123/510 |
| 2007/0193648 | A1 * | 8/2007 | Grantham | F02M 25/0836 141/59 |
| 2008/0173269 | A1 * | 7/2008 | Perry | F16K 47/02 123/90.66 |
| 2013/0015378 | A1 * | 1/2013 | Balsdon | F02M 25/0836 251/12 |
| 2013/0255645 | A1 * | 10/2013 | Grass | F02M 25/0818 123/520 |
| 2017/0036532 | A1 * | 2/2017 | Miura | B60K 15/03519 |

FOREIGN PATENT DOCUMENTS

| | | | |
|---|---|---|---|
| JP | H07-180624 | | 7/1995 |
| JP | 2546618 | Y2 | 9/1997 |
| JP | 2003530520 | A | 10/2003 |

* cited by examiner

VALVE FOR VENTILATION OF A TANK

CROSS REFERENCE TO RELATED APPLICATION

This application claims priority under 35 USC 119 to German Patent Appl. No. 10 2013 112 586.7 filed on Nov. 15, 2013, the entire disclosure of which is incorporated herein by reference.

BACKGROUND

1. Field of the Invention

The invention relates to a valve for ventilation of a tank.

2. Description of the Related Art

U.S. Pat. No. 6,966,347 discloses a method and a device for diagnosing a leak in a tank with increased outgassing of fuel. The device has a valve via which the tank and/or the filter can be supplied with fresh air.

It is the object of the invention to provide an improved valve for ventilation of a tank.

SUMMARY OF THE INVENTION

A valve in accordance with the invention is configured so that the opening behavior of the valve can be influenced as a function of a pressure in the filter so that the valve can be opened farther or more rapidly depending on the selected embodiment.

Opening of the valve farther ensures that particles cannot be deposited between the closing member and the sealing seat, thus preventing the valve from becoming untight over time.

The closing member may be assisted in the opening process as a function of a negative pressure in a feed line to the filter. In a further embodiment, the pressure in the filter is used advantageously for assisting the opening process.

An opening behavior of the closing member may be assisted as a function of a negative pressure in a feed line to an intake pipe of an internal combustion engine may. A greater force is therefore available to move the closing member into the open position.

The valve may have a pressure space in which a movable actuating means is provided. The actuating means may be movable as a function of the pressure in the pressure space and movement of the actuating means may be transmitted to the closing member. Therefore, a simple and reliable operative connection is provided between the pressure in the pressure space and the closing member.

The actuating means may be a membrane that seals off the pressure space. The membrane may be connected operatively to the closing member via a rod. This provides a cost-effective and reliable actuating means.

A further pressure space may be provided and may be connected to the filter. The further pressure space may be bounded by a second membrane that is adjacent to the first space. A switch may be provided in the further pressure space. The second membrane may be designed to actuate the switch in the event of a predetermined negative pressure in the further pressure space.

A further pressure space may be provided and may be connected to the filter. The further pressure space may be bounded by a second membrane that is adjacent to the first space. The second membrane may move the closing member into the open position in the event of a predetermined negative pressure in the further pressure space.

The invention is explained in more detail below with reference to the figures.

DETAILED DESCRIPTION OF THE PREFERRED EMBODIMENTS

Figure 1:
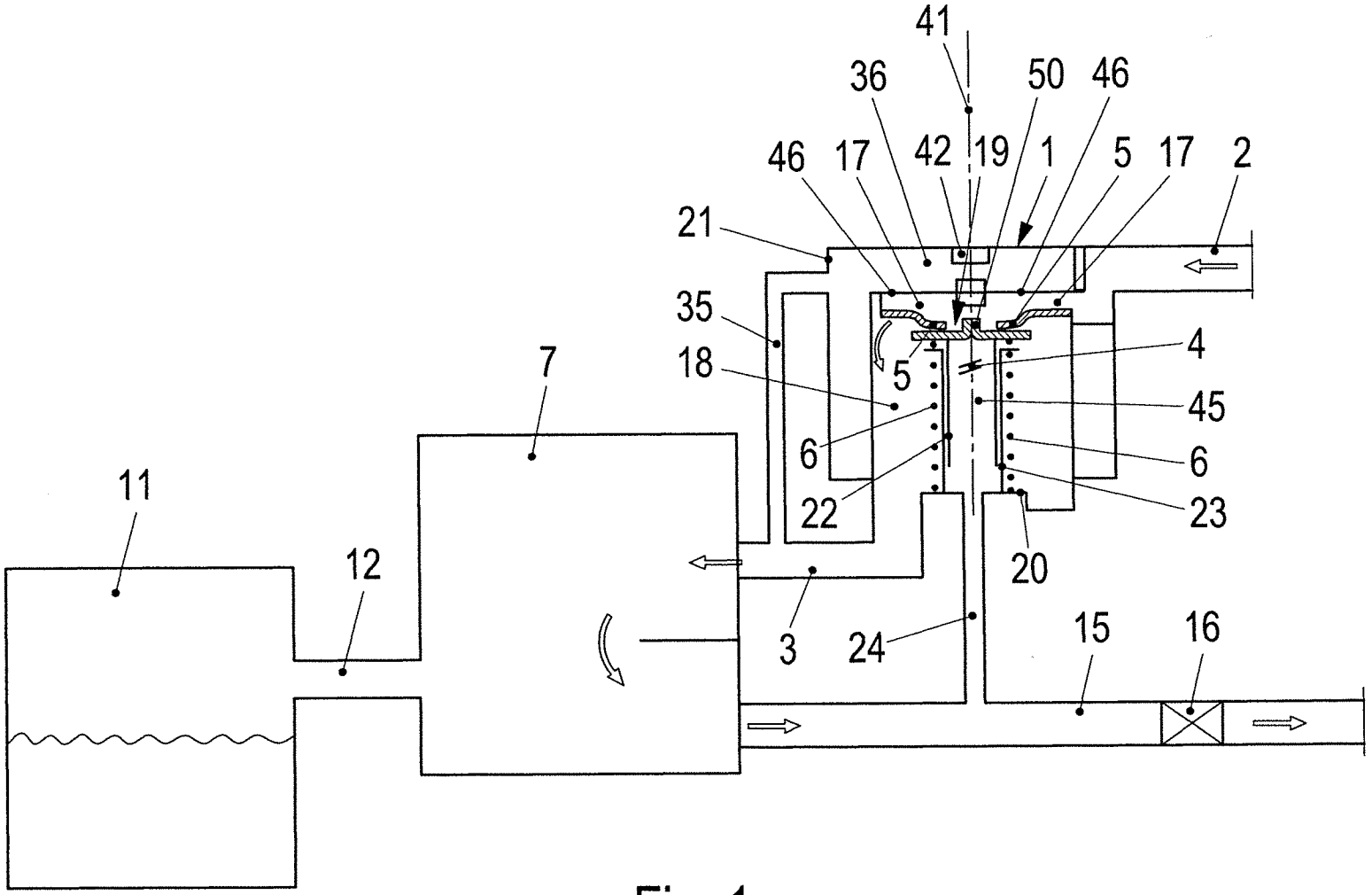
FIG. 1 is a schematic illustration of a tank ventilation system with a filter and a valve.

FIG. 1 is a schematic illustration of a tank ventilation system with a tank 11 that supplies an internal combustion engine with fuel via a line (not illustrated). A venting line 12 connects the tank 11 to a filter 7 that is filled, for example, with activated carbon. The filter 7 uses the activated carbon to filter gaseous fuel out of the gas stream, but has a limited storage capacity for the fuel. The filter 7 therefore has to be purged occasionally.

For this purpose, the filter 7 is supplied with fresh air via a first line 2, a valve 1 and a second line 3. The stream of fresh air is conducted through the filter 7. Thus, stored fuel is absorbed from the activated carbon and is conducted via a feed line 15 to an intake pipe of the internal combustion engine. The feed line 15 contains a switching valve 16 that is switchable into an open position or a closed position as a function of an activation by a control device. A negative pressure prevails in the intake pipe and, when the switching valve 16 is open, is conducted on to the filter 7.

The valve 1 has a housing 21 with a first space 17 into which the first line 2 opens and a second space 18 that is connected to the first space 17 via a control opening 19. A sealing seat 5 surrounds the control opening 19, for example annularly. In addition, the second line 3 is connected via a third connecting line 35 to a third pressure space 36. The third pressure space 36 is separated off from the first space 17 via a membrane 27. The second space 18 contains a closing member 4 that is pretension toward the sealing seat 5 by a spring 6. The spring 6 is designed, for example, as a spiral spring and is supported against a base 20 of the housing 21. One side of the closing member 4 has a sealing surface 50 that sits on the sealing seat 5 in the closed state and closes the control opening 19. In addition, the closing member 4 has a sleeve section 22 that is guided in a sealing manner in a guide sleeve 23. The closing member 4 constitutes a sleeve that is closed on one side. The guide sleeve 23 is guided as far as the base 20. The closing member 4 and the guide sleeve 23 bound a guide space 45. A connecting line 24 is attached to the base 20 and connects the guide space 45 to the feed line 15. The connecting line 24 constitutes a bypass channel. The connecting line 24 and the guide space 45 constitute means which, as a function of a further pressure, exert a force on the closing member 4 to move the closing member 4 into the open position.

If the switching valve 16 of the tank ventilation device of FIG. 1 is opened, the negative pressure in the suction pipe of the internal combustion engine generates a negative pressure in the feed line 15. The negative pressure is conducted both to the guide space 45 via the connecting line 24 and to the second space 18 via the filter 7 and the second line 3. The first line 2 is connected to an ambient pressure. The closing member 4 is drawn in the direction of the base 20 counter to the pretensioning force of the spring 6 due to the pressure difference between the first space 17 and the second space 18 or between the first space 17 and the guide space 45. The control opening 19 is opened in this process. The opening speed of the closing member 4 can be increased by the connecting line 24. In addition, the negative pressure in the guide space 23 is greater than in the second space 18, and therefore a greater overall force acts on the closing member 4. The closing member 4 therefore is drawn down and farther away from the sealing seat 5 than without the provision of the connecting line 24. Furthermore, the closing member 4 is moved into a predetermined opening position which preferably is independent of the volumetric stream that is sucked into the filter 7 via the control opening 19. The closing member 4 therefore always is moved away by a minimum distance from the sealing seat 5 when the valve is opened. The closing member 4 preferably always is moved into a maximum open position during the opening operation.

Figure 2:
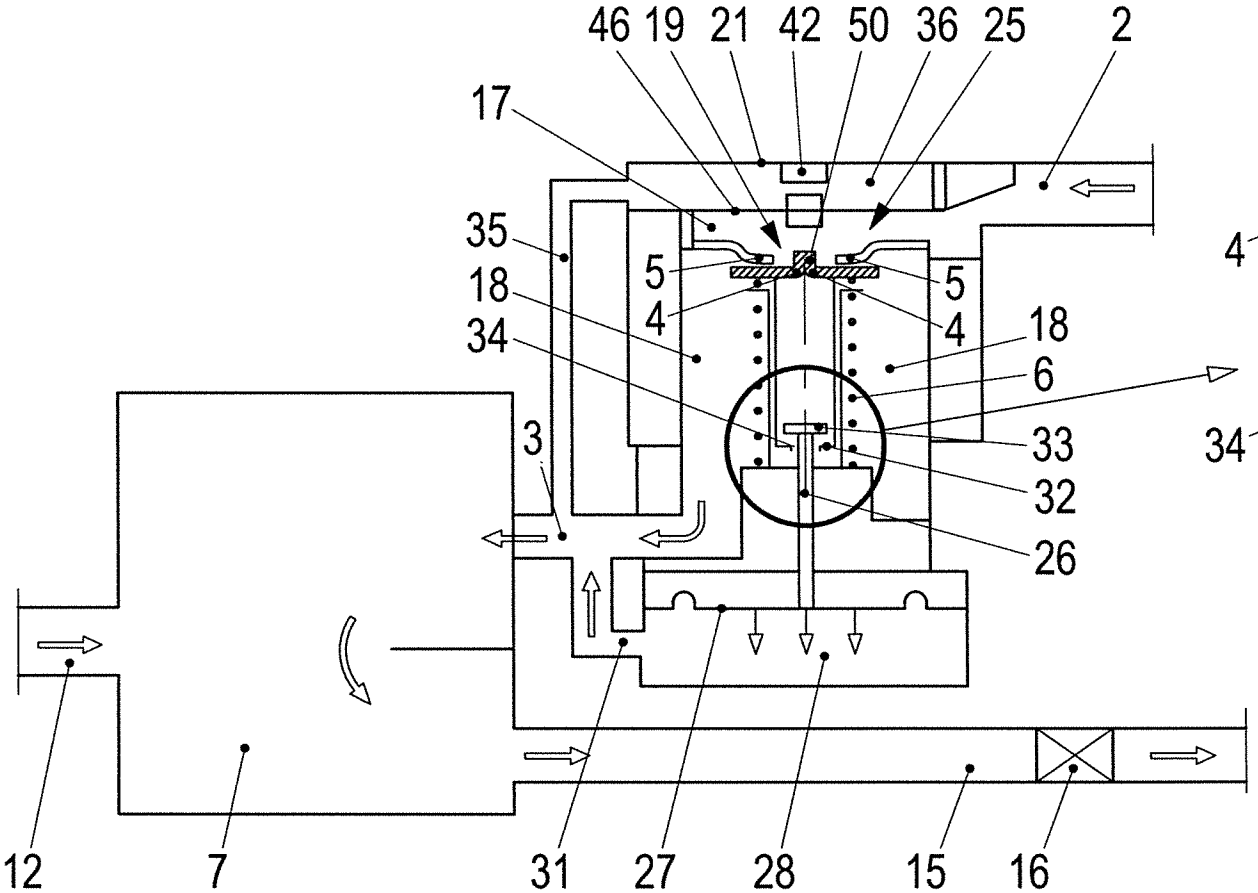
FIG. 2 is a schematic illustration of a second embodiment of a valve.

FIG. 2 shows a device for ventilating the tank and purging a filter 7. The device of FIG. 2 is constructed substantially as the device of FIG. 1, and has a second valve 25 arranged between the first line 2 and the second line 3. The second valve 25 is constructed substantially as the valve 1 from FIG. 1. However, with the closing member 4 is connected to a membrane 27 via a pull rod 26. The membrane 27 bounds a pressure space 28. The pressure space 28 is connected via a second connecting line 31 to the second line 3. The closing member 4 is a pipe that is closed on both ends.

The pull rod 26 is guided through a hole 34 in the base 32 of the closing member 4 and has a stop surface 33 at the free end within the closing member 4. The pull rod 26 is connected via the stop surface 33 to the base 32 of the closing member 4 in such a manner that the closing member 4 can be moved in the direction of the base 20 of the housing independently of the movement of the pull rod 26. In addition, depending on the position of the closing member 4 and on the position of the pull rod 26, the stop surface 33 can contact the base 32 of the closing member 4 and draw the closing member 4 down from the sealing seat 5 in the direction of the base 30. A negative pressure in the pressure space 28 assists the opening behavior of the closing member 4 so that, even in the event of a smaller differential pressure between the first and second space 17, 18, the closing member is drawn farther away from the sealing seat 5 up to a maximum distance. The pressure space, the membrane and the pull rod constitute means which, as a function of a further pressure, exert a force on the closing member 4 to move the closing member 4 into the open position. Instead of a membrane, a piston could also be provided, the position of which piston is changed as a function of the pressure in the pressure space.

Figure 3:
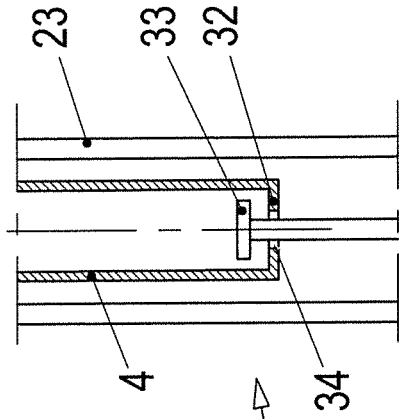
FIG. 3 is an enlarged illustration of a partial detail of the valve from FIG. 2.

FIG. 3 shows, in a partial detail, an enlarged illustration of a lower end of the closing member 4. The closing member 4 has a sleeve shape and the pull rod 26 is guided through the hole 34 in the base 32.

Opening the switching valve 16 generates a negative pressure in the filter 7 and in the second line 3 due to the negative pressure in the suction pipe of the internal combustion engine. A corresponding negative pressure therefore also prevails in the second space 18. The pressure of the surroundings prevails in the first space 17 since the first line is connected to an ambient pressure.

Negative pressure also prevails in the pressure space 28 because of the second connecting line 31. Since an atmospheric pressure prevails in a region above the membrane 27, the membrane 27 is moved down and away from the sealing seat 5. The membrane 27 correspondingly moves the pull rod 26 down. Thus, the stop surface 33 contacts the base 32 of the closing member 4 and draws the closing member 4 down away from the sealing seat 5. In addition, the atmospheric pressure in the first space 17 also acts on the end of the closing member 4. As a result, the closing member 4 is drawn down and away from the sealing seat 5 as a function of the pressure difference between the first space 17 and the second space 18 or between the upper pressure space 29 and the lower pressure space 30. The provision of the membrane 27 with the pull rod 26 causes the closing member 4 to be drawn away from the sealing seat 5 by a predetermined distance independently of the volumetric stream flowing via the control opening 19. The closing member 4 preferably always is drawn as far as a maximum opening position during the opening process. The closing member therefore is drawn farther away from the sealing seat 5 than without the provision of the pressure space 28 with the membrane 27. If the switching valve 16 is closed, the pressure differences are equalized again and the closing member 4 is pressed by the spring 6 into the closed position on the sealing seat 5.

Figure 4:
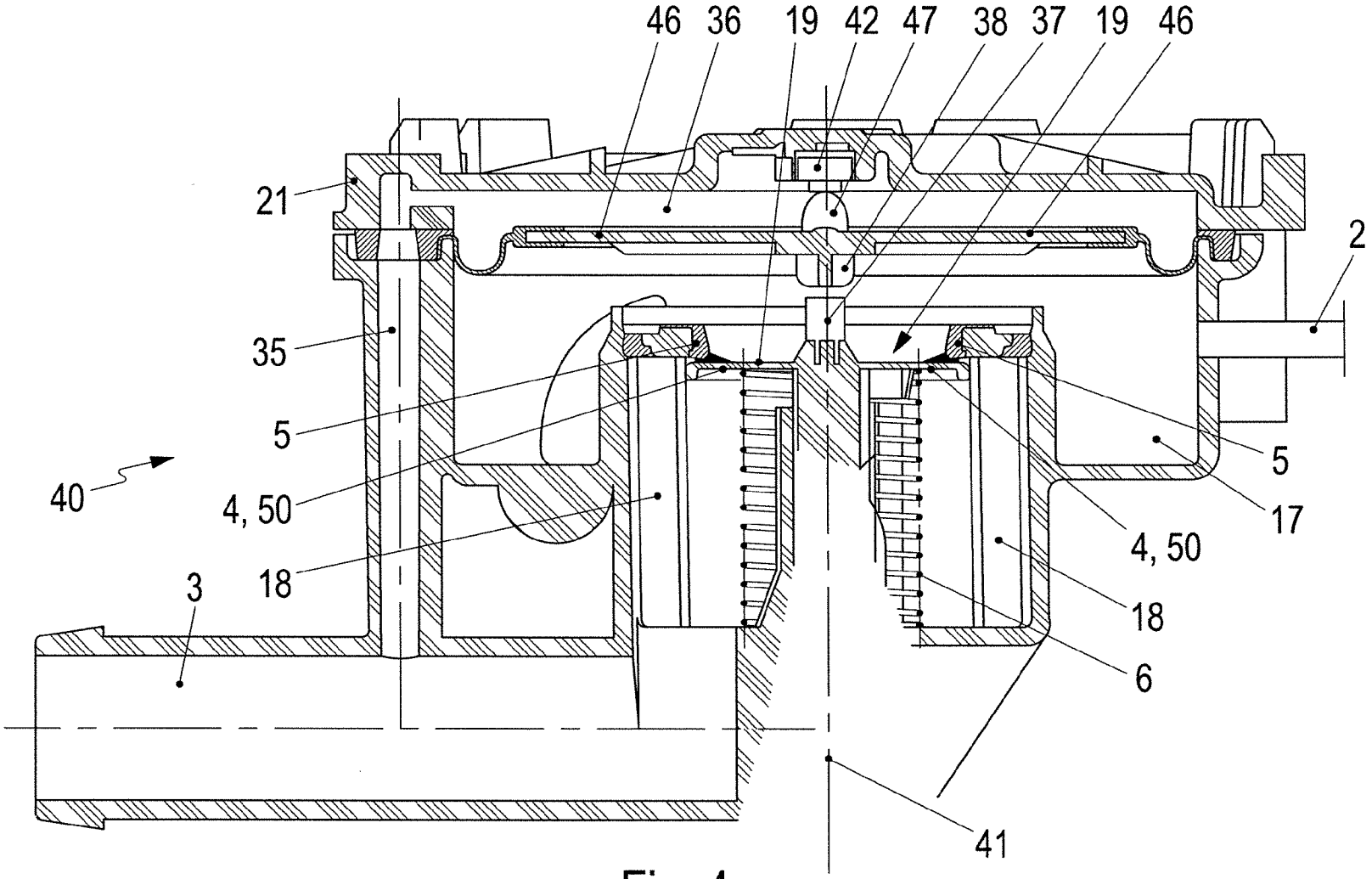
FIG. 4 shows an embodiment of a further valve for a tank ventilation system in a first operating state.

FIG. 4 shows an enlarged cross section through a third valve 40 that can be designed according to FIG. 1 or 2 and has corresponding means (not illustrated) which, exert a force on the closing member 4 to move the closing member 4 into the open position V. The design of the third pressure space 36 is illustrated more precisely in FIG. 4. The third valve 40 has a housing 21 in which the first space 17 is formed. The first space 17 is connected via a first line 2 to an ambient pressure. The first space 17 is connected via the control opening 19 to a second space 18. The control opening 19 is surrounded by a sealing seat 5 that is assigned the closing member 4 and that is arranged in the second space 18. The closing member 4 is a plate that is displaceable on the movement axis 41 in the second space 18. A spring 6 pretensions the closing member 4 onto the sealing seat 5. In the illustrated closed position, the closing member 4 closes the control opening 19.

The second space 18 is connected to the second line 3 and the second line 3 attaches to a fuel tank or a filter, as show in FIG. 1. In addition, the second line 3 is connected via a third connecting line 35 to a third pressure space 36. The third pressure space 36 is separated from the first space 17 via the second membrane 46. The second membrane 46 has an actuating element 38 in a center that is arranged on the movement axis 41. The actuating element 38 is arranged in the first space 17. Opposite the actuating element 38, the closing member 4 has a pin 37 on the end side. In the situation illustrated, the actuating element 38 is spaced from the pin 37. An atmospheric pressure prevails in the first space 17 in the situation illustrated. A pressure that is not lower than atmospheric pressure prevails in the second space 18 and in the third pressure space 36. The negative pressure present in the second space 18 is therefore not sufficient to raise the closing member 4 from the sealing seat 5 counter to the pretensioning force of the spring 6 on the basis of the pressure difference from the first space 17.

The second membrane 46 has a second actuating element 47 arranged in the third pressure space 36 opposite the actuating element 38. A switch 42 is formed on the housing 21 above the second actuating element 47. The switch 42 protrudes into the third pressure space 36.

Figure 5:
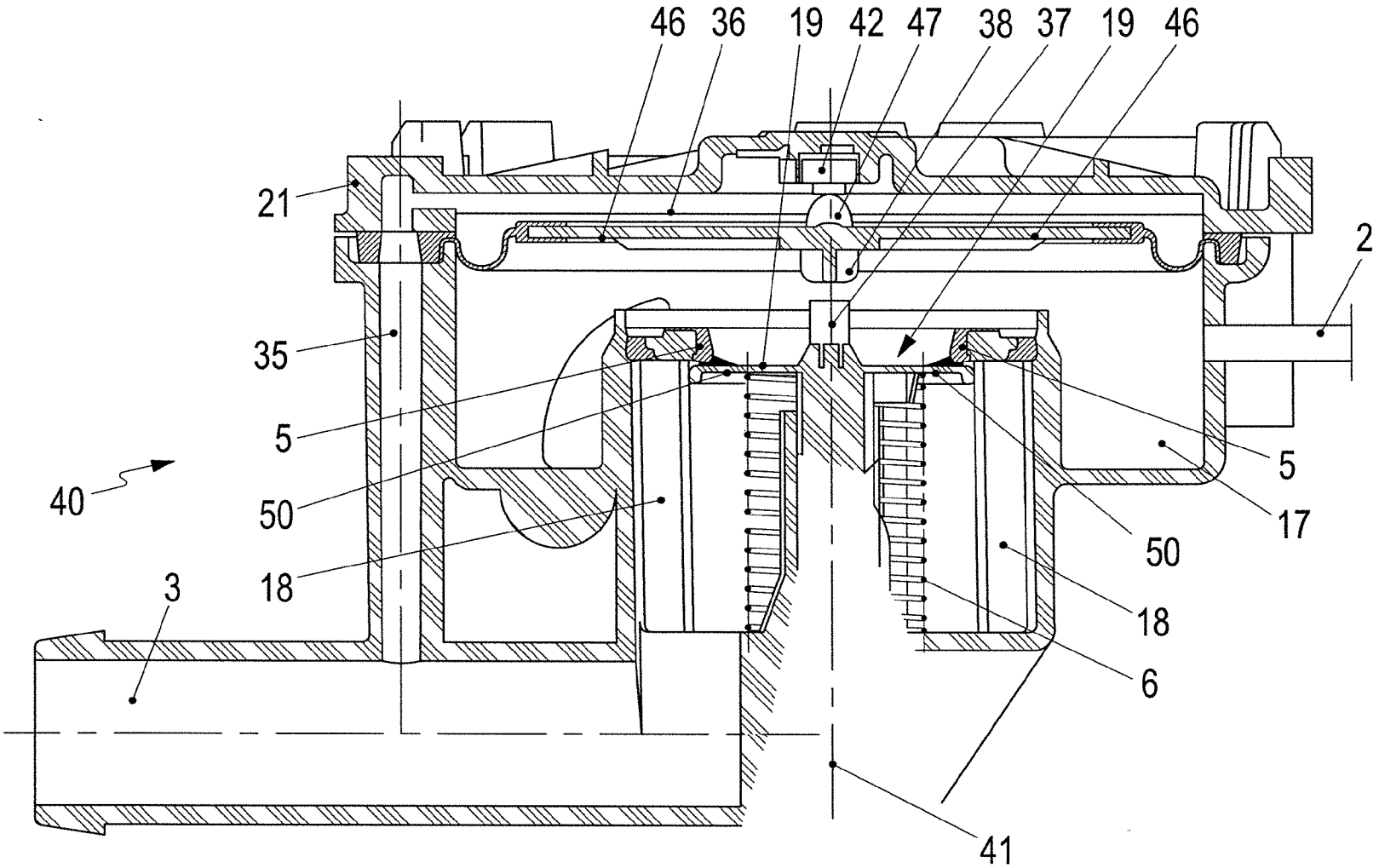
FIG. 5 shows the further valve in a second operating state.

FIG. 5 shows a third valve 40 in a second state where an atmospheric pressure prevails in the first space 17 and a negative pressure prevails in the second and third spaces 18 and in the third pressure space 36. The negative pressure is generated, for example, by the fuel tank cooling or by the filter being supplied with negative pressure via a connection to the suction pipe. In the situation illustrated, the negative pressure in the third pressure space 36 and in the second space 18 may be −2.5 mbar in relation to the pressure in the first space 17. In this situation, in comparison to the situation in FIG. 4, the second membrane 46 is moved up toward the switch 42. The second actuating element 47 actuates the switch 42 and therefore indicates that there is no leak in the tank system. The negative pressure is produced by cooling the fuel in the tank, for example, after the vehicle is switched off. If the switch 42 is not actuated, i.e. a predetermined negative pressure is not produced after the vehicle has been switched off, then the tank system is not tight.

Figure 6:
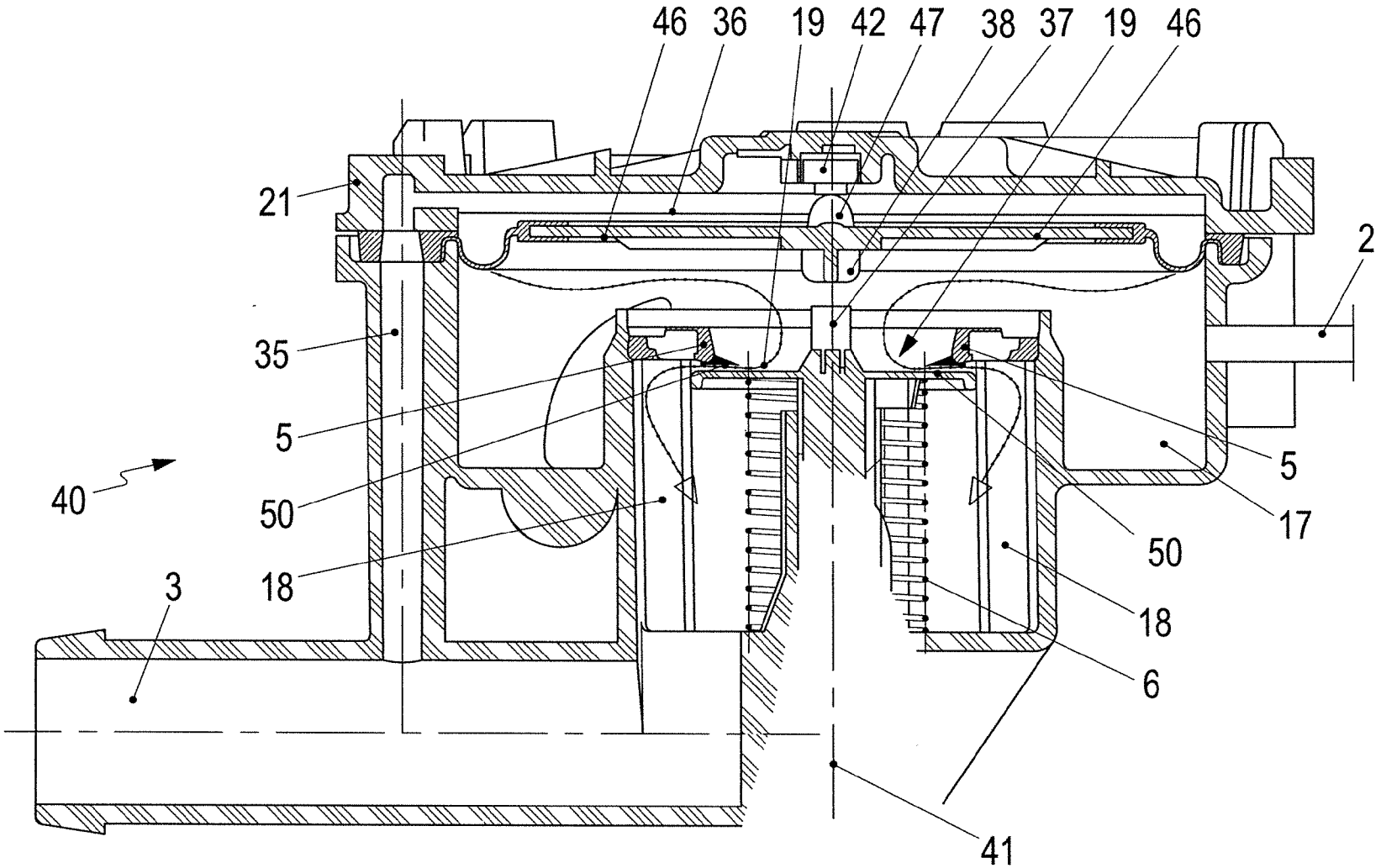
FIG. 6 shows the further valve in a third operating state.

FIG. 6 shows the third valve 40 in a further situation in which the pressure in the third pressure space 36 and in the second space 18 is −6 mbar. In this situation, the closing member 4 has already been raised from the sealing seat 5 and air flows from the first space 17 via the second space 18 into the second line 3. If the pressure difference between the first space 17 and the second space 18 drops, the closing member is pressed again onto the sealing seat 5 into the closed position because of the pretensioning force of the spring 6.

Figure 7:
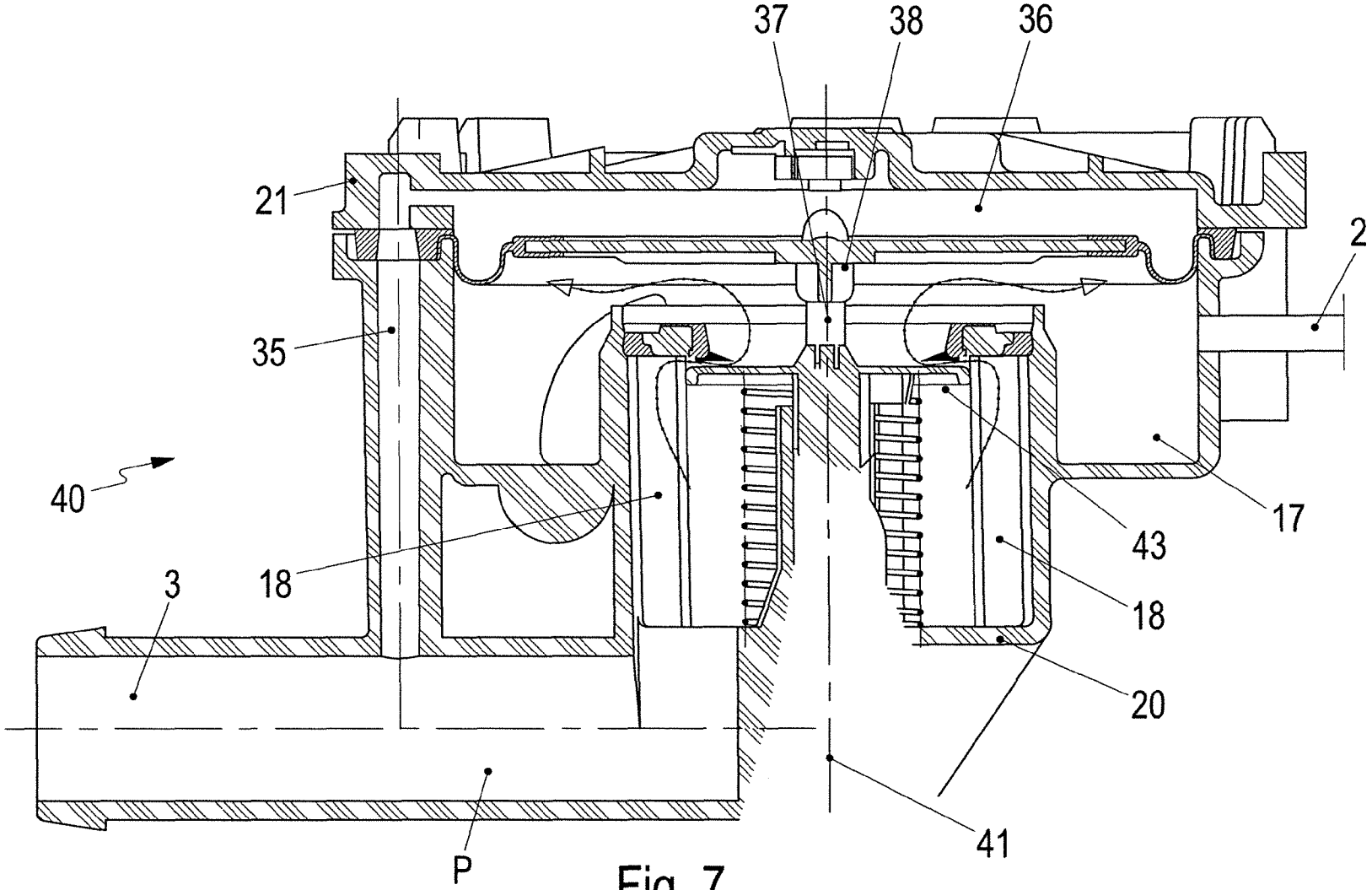
FIG. 7 shows the further valve in a fourth operating state.

FIG. 7 shows the third valve 40 in a situation in which, via the second line 3, a positive pressure is introduced into the second space 18 and into the third pressure space 36 with a positive pressure of, for example, +1 mbar in relation to the pressure in the first space 17. The second membrane 46 has a larger surface than the pressure surface 50 of the closing member 4. Owing to the positive pressure in the third pressure space 36, the second membrane 46 is moved downward, wherein the actuating element 38 comes into contact with the pin 37. In the process, the second membrane 46 presses the closing member 4 downward from the sealing seat 5 in the direction of the base 20 and therefore opens the control opening 19. As a result, air can escape from the second space 18 via the first space 17 into the first line 2. The situation illustrated in FIG. 7 corresponds, for example, to the use in which the second line 3 is connected to the fuel tank via the filter 7. The negative pressure can be built up, for example, in the fuel tank by refueling the tank. If the pressure difference between the third pressure space 36 and the first space 17 drops by a predetermined difference, the closing member 4 is pressed again onto the sealing seat 5 by the spring 6.

The valve 1, the second valve 25 and the third valve 40 are designed so that a negative pressure in the second line 3 or in the filter 7 or in a feed line 15 to a suction pipe of the internal combustion engine is used to assist an opening behavior of the closing member 4 to raise the closing member by a determined distance from the sealing seat independently of the volumetric stream which flows through the valve.

What is claimed is:

1. A valve for ventilation of a tank, comprising:

a housing;

a sealing seat disposed in the housing and forming a control opening so that the sealing seat surrounds the control opening;

a first space that is connectable via a first line to a fresh air inlet and a second space that is connectable via a second line to a filter inlet, the first and second spaces being connectable to each other via the control opening;

a closing member disposed at least partly in the second space and moveable between an open position where the closing member permits communication through the control opening between the first and second spaces and a closed position where the closing member engages the sealing seat and closes the control opening;

a tensioning means pretensioning the closing member into the closed position against the sealing seat, the closing member being movable into the open position and against forces of the tensioning means as a function of a pressure difference between the first and the second spaces;

an engine feed line extending from an outlet of the filter to an intake pipe of an engine;

a switching valve for selectively providing communication between the engine feed line and the intake pipe of the engine; and an opening assist line extending from a side of the closing member opposite the first space to a position in the engine feed line downstream of the filter for assisting opening of the closing member when the switching valve is open and pressure in the first space exceeds pressure in at least one of the second space, the filter and the engine feed line.

2. The valve of claim 1, further comprising a guide space, the closing member being guided in a sealing manner in the guide space, and the opening assist line being provided between the guide space and the engine feed line from the filter to the intake pipe of the engine.

3. The valve of claim 1, further comprising a pressure space that is connected via the opening assist line to the filter or to the second line, an actuating means provided in the pressure space for sealing off the pressure space, the actuating means being connected operatively to the closing member and being movable as a function of the pressure in the pressure space and the movement of the actuating means being transmitted to the closing member.

4. The valve of claim 3, wherein the actuating means is a membrane that seals off the pressure space, the membrane being connected operatively to the closing member via a rod to move the closing member into the open position.

5. The valve of claim 4, wherein the membrane and the rod are designed so that a negative pressure in the pressure space moves the closing member into the open position.

6. The valve of claim 3, wherein a further pressure space is provided, wherein the further pressure space is connected via a connecting line to the second line or to the filter, the further pressure space being bounded by a second membrane that is adjacent to the first space, a switch being provided in the further pressure space, the second membrane actuating the switch in the event of a predetermined negative pressure in the further pressure space.

7. The valve of claim 6, wherein the further pressure space is bounded by the second membrane that is adjacent to the first space, the second membrane is configured to move the closing member into the open position in the event of a predetermined negative pressure in the further pressure space.

* * * * *